United States Patent [19]

Chadwick et al.

[11] 4,065,004

[45] Dec. 27, 1977

[54] METHOD AND APPARATUS FOR RESEALING THE LARGE BELL ROD IN A DOUBLE BELL CHARGING SYSTEM FOR A BLAST FURNACE

[75] Inventors: Ronald M. Chadwick, Collinville; David A. Shearlock, Granite City, both of Ill.

[73] Assignee: National Steel Corporation, Pittsburgh, Pa.

[21] Appl. No.: 690,725

[22] Filed: May 27, 1976

[51] Int. Cl.[2] ..... F27B 11/12

[52] U.S. Cl. ..... 214/36; 214/152; 277/2; 277/64

[58] Field of Search ..... 214/36, 37, 152; 266/184; 277/2, 9, 64

[56] References Cited

U.S. PATENT DOCUMENTS

| | | | |
|---|---|---|---|
| 3,070,242 | 12/1962 | Berczynski | 214/36 |
| 3,233,824 | 2/1966 | Johnson | 277/64 X |

*Primary Examiner*—Robert G. Sheridan

*Attorney, Agent, or Firm*—Shanley, O'Neil and Baker

[57] ABSTRACT

When the packing rings about the large bell rod in a double bell blast furnace charging system become worn, a new seal is established about the large bell rod above the worn seal without requiring shutdown of the furnace or removal and replacement of the worn seal and bell rod. This is achieved by forming an enclosure in situ about the large bell rod directly above the worn packing to entrap leakage past the worn packing in the enclosure, and by providing a new seal assembly including new packing rings about the large bell rod in the upper end of the enclosure where the large bell rod emerges. The upper end portion of the enclosure is secured relative to the large bell rod by brackets projecting outwardly from the enclosure to a point where they are fastened to hanger rods conventionally utilized to raise and lower the small bell rod. Preferably, the half sections of the enclosure are manufactured in a plurality of vertical sections secured and sealed together one above the other in serial fashion about the bell rod.

31 Claims, 7 Drawing Figures

FIG. 3
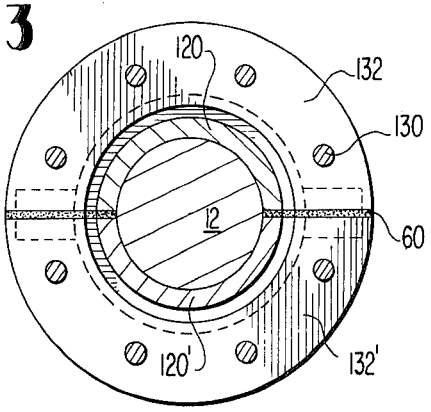
FIG. 4
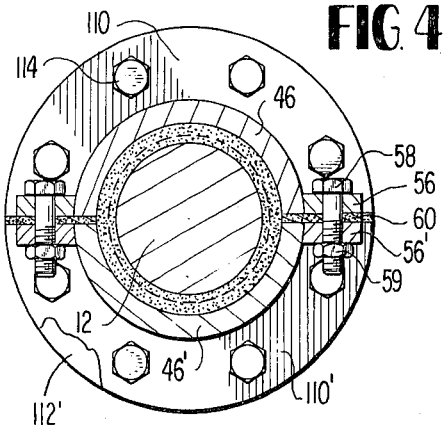
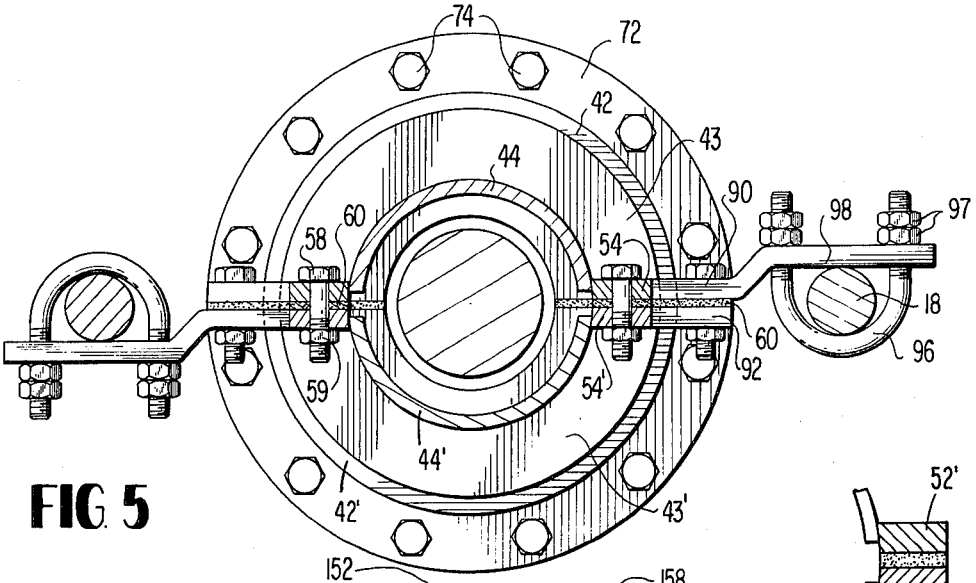
FIG. 5
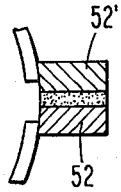
FIG. 7
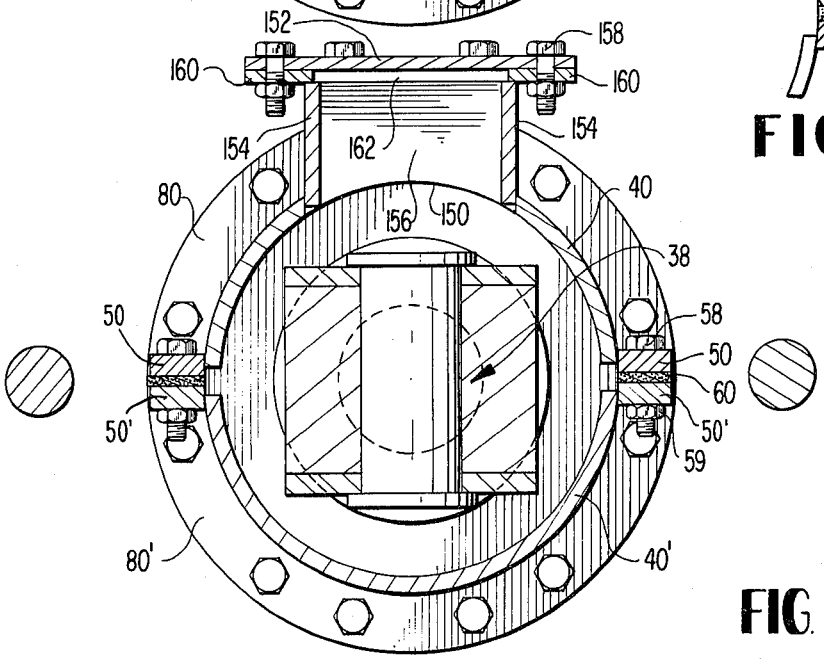
FIG. 6

METHOD AND APPARATUS FOR RESEALING THE LARGE BELL ROD IN A DOUBLE BELL CHARGING SYSTEM FOR A BLAST FURNACE

OBJECTS OF THE PRESENT INVENTION

The present invention generally relates to a double bell charging system for a blast furnace and more specifically, to a method and apparatus for resealing the large bell rod after an original seal between the large and small bell rods has become worn.

It is a primary object of the present invention to provide novel method and apparatus for resealing in situ the large bell rod of a double bell system of a blast furnace after an original seal between the small and large bell rods has become worn. Included herein is such method and apparatus which do not require shutdown of the furnace and stoppage of production, or removal and replacement of the worn seal or the large bell rod or any disassembly of the double bell system.

A further object of the present invention is to provide such method and apparatus which employ parts that may be easily manufactured and assembled about the bell rod utilizing conventional fastening and welding techniques as well as conventional packing materials and sealing gaskets.

A further object of the present invention is to provide such method and apparatus which will achieve the above objects and at the same time produce a highly effective seal about the large bell rod to contain leakage along the large bell rod from the interior of the small bell rod.

DRAWINGS

Other objects and advantages of the present invention will become apparent from the following more detailed description taken in conjunction with the drawings in which:

FIG. 3 is an enlarged cross-sectional view taken generally along lines 3—3 of FIG. 2;

FIG. 4 is an enlarged cross-sectional view taken generally along lines 4—4 of FIG. 2;

FIG. 5 is an enlarged cross-sectional view taken generally along lines 5—5 of FIG. 2;

FIG. 6 is an enlarged cross-sectional view taken generally along lines 6—6 of FIG. 2; and FIG. 7 is a fragmental, cross-sectional view taken generally along lines 7—7 of FIG. 1.

DETAILED DESCRIPTION

Figure 1:
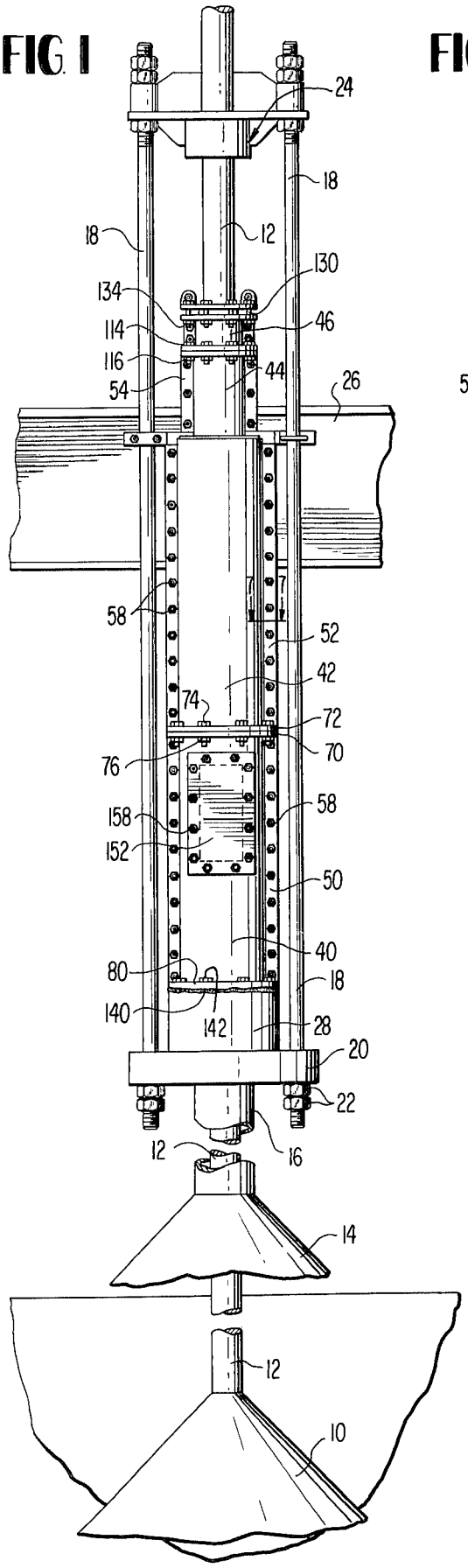
FIG. 1 is an elevational view of a double bell charging system for a blast furnace in which the large bell has been resealed in accordance with the method and apparatus of the present invention; the view omitting the blast furnace proper and the charging hoppers associated with the large and small bells.

Referring now to the drawings in detail, there is shown in FIG. 1 for illustrative purposes only, portions of a double bell charging system for a blast furnace in accordance with conventional practice; the blast furnace proper, the charging hoppers and the basic support structure for the system being omitted for clarity as they form no part of the present invention. Charging a blast furnace through a double or other multiple bell and hopper system is well-known in the art and industry and therefore need not be described in any detail; however, an explanation of such charging, including the cooperation of the bells may be found in the disclosure of U.S. Pat. No. 3,070,242 as well as in the text, THE MAKING, SHAPING AND TREATING OF STEEL, 9th Edition, Chapter 15, Pages 435, 436 and 437, edited by Harold E. McGannon, which disclosures are hereby incorporated by reference into this application.

Returning to FIG. 1, it discloses a large bell generally designated 10 raised and lowered through means of a vertically disposed rod 12 known as a "large bell rod"; and a small bell 14 raised and lowered by means of a vertically disposed tubular member 16 known as a "small bell rod" concentrically receiving large bell rod 12. Small bell rod 16 is hung from hanger rods 18 through means of a yoke 20 conventionally fixed to small bell rod 16, and to the hanger rods 18 through nut fasteners 22. The upper ends of hanger rods 18 are conventionally secured to second yoke 24 through which passes large bell rod 12. Through actuating mechanism, not shown, hanger rods 18 are lowered or raised to lower or raise small bell rod 14 which movement, of course, takes place relative to large bell rod 12. Large bell rod 12 is raised and lowered relative to small bell rod 14 through means of an actuating mechanism also not shown. Support for the charging hoppers and other mechanisms associated with the charging system is partially shown in the form of an I-beam 26.

Figure 2:
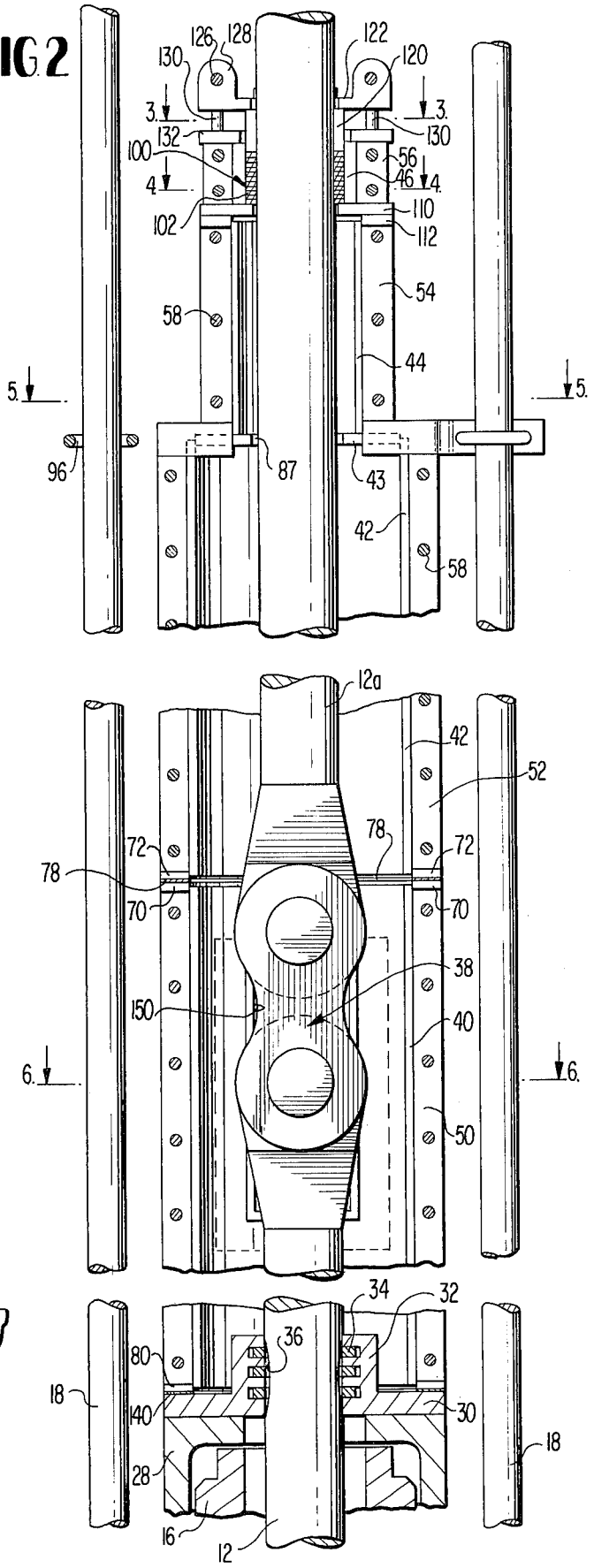
FIG. 2 is a view similar to FIG. 1 but in cross section and omitting certain parts shown in FIG. 1.

Referring now to the bottom portion of FIG. 2, the top portion of small bell rod 16 is shown as enclosed by what will be termed a "yoke connecting means" 28 which is utilized to fix small bell rod 16 to yoke 20 (see FIG. 1) to enable small bell rod 16 to be raised and lowered through yoke 20 and hanger rods 18 fixed to the yoke as described above. Small bell rod 16 itself, together with yoke connecting means 28 are conventional.

Fluid and other material are prevented from moving along large bell rod 12 from the interior of the upper end of small bell rod 16 by means of a conventional seal assembly. The latter includes a seal housing having a base 30 fixed (by means not shown) on top of yoke connecting means 28 as shown in the bottom of FIG. 2, and a central upstanding sleeve or hub 32 containing a plurality of overlying annular grooves receiving conventional packing rings 34; there being three packing rings shown in the specific embodiment. Packing rings 34, when initially applied during assembly of the small and large bell rods, are intended to engage about large bell rod 12 to establish a seal preventing the flow of fluid or other material from the interior of small bell rod 16 along large bell rod 12. Packing rings 34 may be formed from any suitable or conventional material and form no part of the present invention.

The need of the present invention arises when packing rings 34 become worn and fluid is permitted to escape along large bell rod 12 past packing rings 34. This condition results in wear of large bell rod 12 which, of course, is undesirable; the wear being illustrated by the concave surfaces 36 shown in the bottom of FIG. 2.

In the past, when such wear of packing rings 34 and large bell rod 12 occurred, it was the practice to shutdown the blast furnace and to change the worn bell rod and apply new packing rings. Shutdown of the furnace results in loss of production and can also cause damage to the furnace lining.

The present invention does away with the need to shutdown the furnace or to install a new bell rod. According to the method of the present invention, after large bell rod 12 becomes worn such as indicated at 36 in FIG. 2, an enclosure which may be termed an adapter, is formed in situ about the large bell rod directly above the worn seal 34 without requiring shutdown of the furnace and while maintaining the worn seal 34 in tact. The enclosure is sealed along a longitudinal portion of the large bell rod 12 above the worn seal 34; and at the top of the enclosure, a new packing ring assembly, generally designated 100, is inserted to complete sealing of the section of the large bell rod 12 above the worn sealing rings 34.

One preferred embodiment for forming the enclosure about the large bell rod 12 is disclosed in the drawings as including a plurality of pairs of generally semicylindrical half sections or shells made from suitable material, such as stainless steel, and joined along longitudinally extending edge portions to define a generally hollow cylindrical enclosure about large bell rod 12. Although in the shown embodiment, four pairs 40, 40'; 42, 42'; 44, 44' and 46, 46' of half sections are employed with one pair above the other in forming the enclosure, a greater or lesser number of pairs may be employed if desired.

When the portion of large bell rod 12 to be sealed above original seal 34 contains a bell rod joint such as 38 in the disclosed embodiment, it is of course, necessary that the diameter or transverse dimension of the enclosure be sufficient to accommodate joint 38. In the specific embodiment, joint 38, which itself is conventional, lies almost entirely within the lower enclosure sections 40, 40' as is shown in FIG. 2. At the point where the enclosure extends upwardly beyond joint 38, the enclosure may be reduced in diameter or cross section, and this is illustrated by half sections 44, 44' which have a diameter less than the diameter of the lower half sections 40, 40' and 42, 42'.

It will be readily apparent that if desired, half sections 40 and 42; and 40' and 42' could be manufactured as an integral piece; however, to facilitate assembly about large bell rod 12 in situ, it is preferred that they be formed as separate vertical sections of the enclosure. As noted above, the half sections of each pair are mated, secured and sealed together about large bell rod 12 along longitudinally extending edge portions which preferably are elongated flanges 50, 50'; 52, 52', 54, 54' and 56, 56' welded to their respective half sections. The flanges of each pair of half sections are secured together by bolts 58 and nuts 59. In addition, elongated gaskets 60 formed from asbestos material are interposed between all bolted sections of the enclosure. FIGS. 4 through 6 clearly disclose the bolted flanged joints with sealing gaskets 60. The flanges are also made from stainless steel.

In order to join and seal the lower half sections 40, 40' and those 42, 42' immediately above it, these sections are formed with mating semicircular flanges 70 and 72 adapted to engage each other and to be fastened together by means of bolts 74 and nuts 76. In addition, these joints contain an asbestos gasket 78 sandwiched between the flanges. In manufacture, flanges 70 and 72 may be secured to their respective shell sections 40 and 42 such as by welding.

The lower ends of the lowermost half sections 40, 40' are similarly provided by semicircular flanges 80, 80' adapted to be bolted and/or welded to the top of the base 30 of the housing of packing rings 34 during the initial phase of assembly of the enclosure about bell rod 12.

Although the pair of half sections 42, 42' could be secured to the pair of half sections 44, 44' immediately above the former during assembly around large bell rod 12; in the preferred embodiment, these sections are secured together during fabrication prior to assembly about the large bell rod. That is to say, each half section of pair 42, 42' is secured to a half section of pair 44, 44' during fabrication and then the half sections of each pair are secured and sealed together after they are assembled about large bell rod 12. Sections 42, 42' are respectively secured to the corresponding sections 44, 44' by means of welding the lower edge of sections 44, 44' to semicircular top plates 43, 43', respectively, fixed such as by welding to the top edge portions of sections 42, 42' to close the same when these parts are assembled about bell rod 12. As shown in FIG. 2, top plates 43, 43' (only one shown) define a central circular opening 87 for receiving bell rod 12.

In addition, at the juncture of sections 42, 42' and 44, 44', two bracket assemblies are incorporated in these sections to laterally project outwardly from the top of the enclosure at diametrically opposed locations for connection to hanger rods 18 of small bell rod 16. In the preferred embodiment shown, and with reference to FIGS. 2 and 5, each bracket assembly includes a pair of straps 90 and 92 formed from stainless steel bar material and being welded to the peripheral surface of half sections 44 and 44', respectively, in alignment below flanges 54 and 54' to which they may also be welded. In addition, bracket straps 90 and 92 are also welded to the radially extending edges of top plates 43 of sections 42 and 42', respectively, so as to lie directly above and in the same plane as flanges 52 and 52'. Asbestos gaskets 60 which extend between bolted flanges 52 and 52' of sections 42 and 42' also extend between bracket straps 90 and 92 as shown in FIG. 5. Bracket straps 90 in each bracket assembly are formed with an offset portion **90*a* having a pair of apertures for receiving the legs of a U-bolt 96 which is fastened about hanger rods 18 by nuts 97 to further secure the enclosure about large bell rod 12**.

The uppermost half sections 46, 46' are utilized in establishing the new seal assembly 100 comprised of a plurality of packing rings 102 engaged about large bell rod 12 and the internal surface of half sections 46. For securement to half sections 44, 44', half sections 46, 46' are provided with semicircular horizontal flanges 110, 110' to be mated with corresponding semicircular horizontal flanges 112, 112' provided on the upper end of half sections 44, 44' as shown in FIG. 2. These flanges are bolted together by bolts 114 and fastened by nuts 116. As indicated above, an asbestos gasket ring is interposed between flanges 110, 110' and 112, 112'. To provide a support for packing rings 102 of the new seal, flanges 110, 110' of half sections 46, 46' are dimensioned to extend radially inwardly to provide a ledge for receiving the packing rings 102 as shown in FIG. 2. As noted above, half section 46 is secured about bell rod 12 to half section 46' by vertical flanges 56, 56' which are fastened and sealed together by bolts 58, nuts 59 and asbestos seal 60.

In accordance with one of the advantages of the present invention, packing rings 102 may be supplied by standard or conventional rings which are readily available. It is preferred that a set of eleven packing rings 102 be employed, one above the other, and such may be provided by a Garlock #530 Chevron packing set which is commercially available. Packing rings 102, of course, are split so that they may be laterally applied about large bell rod 12.

In order to apply pressure to packing rings 102, a split gland is provided, again by half sections including semicylindrical gland sections 120, 120' which are fixed to and depend from collar sections 122, 122' shown as being semicircular plates dimensioned to fit around large bell rod 12. Collar sections 122, 122' are fixed together about large bell rod 12 during assembly through means of nuts and bolts 126 received in ears 128 upstanding from collar plates 122, 122'. As shown in FIGS. 2 and 3, the split gland is also supported on sections 46, 46' by bolts 130 received through collar sections 122, 122' and horizontal semicircular flanges 132, 132' fixed to the top of sections 46, 46'. When gland sections 120, 120' are finally installed about large bell rod 12, they will extend in coaxial alignment with, and engage, packing rings 102 to establish sufficient pressure for causing sealing contact between packing rings 102 and shell sections 46, 46' on one side and large bell rod 12 on the other side. Pressure on packing rings 102 may be adjusted by moving gland sections 120, 120' axially along bell rod 12, and this is accomplished by adjusting nuts 134 on bolts 130.

In assembling the enclosure about the large bell rod 12, the lowermost half sections 40, 40' are first placed around large bell rod 12 and secured and sealed together along their vertical flanges through means of bolts 58, nuts 59 and asbestos gaskets 60. In addition, the lower circular open end of sections 40, 40' is secured and sealed to base 30 of the seal housing containing worn packing rings 34. This may be accomplished by welding or by bolting horizontal flanges 80, 80' to base 30 of the seal housing with an asbestos gasket 140 interposed between these parts; the latter securement method being shown in FIG. 1 of the drawings where the bolts are designated 142. The next pair of half sections 42, 42', together with half sections 44, 44', are then secured and sealed in place about large bell rod 12 in similar fashion and with the lower horizontal flanges 72, 72' of sections 42, 42' bolted and sealed to the upper horizontal flanges 70, 70' of half sections 40, 40'. To facilitate this assembly phase, U-bolts 96 may be fastened about hanger rods 18 prior to the final bolting of sections 42, 42' and 44, 44'.

Half sections 46, 46' may then be secured and sealed together about bell rod 12 and with their horizontal flanges 110, 110' secured and sealed to flanges 112, 112' of the next lower sections 44, 44'. Packing rings 102 are then installed about bell rod 12 and within half sections 46, 46'. The split packing gland sections 120, 120' may then be installed and properly adjusted axially of bell rod 12 through nuts 134 on bolts 130 to establish the necessary seal at the top of the enclosure so that the entire section of the bell rod 12 between the original packing rings 34 and the new packing rings 102 will be sealed by the enclosure.

In order to permit access into the interior of the enclosure for inspection after it is assembled and sealed about bell rod 12, an access opening is provided in one of the adaptor sections together with a closure which is removably attached to normally close the access opening. In the preferred embodiment shown, this is achieved through an opening 150 shown as rectangular in FIG. 2 provided in half section 40 so as to extend longitudinally along the axial direction of bell rod 12 with the opening 150 being centered between the opposite longitudinal edges or flanges 50 of half section 40 and lying in the region of bell rod joint 38 when the sections 40, 40' are assembled in place about bell rod 12. In order to accommodate a closure 152 for access opening 150, a housing shown as rectangular is formed about opening 150 by opposite parallel side plates 154 and parallel top and bottom plates 156 welded to each other and to section 40 about the edge of opening 150 as best shown in FIG. 6 (only bottom plate 156 and side plates 154 are shown in FIG. 6). Plates 154 and 156 thus define a passage in communication with access opening 150; and this passage is closed during operation of the blast furnace by closure plate 152 which is sealed and bolted at 158 to a rectangular mouth formed on the outer end of housing 154, 156 by parallel opposite side bars 160 and top and bottom bars 162 as shown in FIG. 6. Bars 160, 162 are fixed to side plates 154 and top and bottom plates 156, such as by welding. As is the case with all the parts of the enclosure described above, with the exception of the packing rings and asbestos gaskets; the closure plate 152 and its associated support housing 154, 156, 160, 162 are formed from stainless steel.

When it is desired to inspect the interior of the enclosure, for example, for wear on the bell rod 12 or the joint 38; bolts 158 and closure plate 152 may be removed to allow such inspection through access opening 150.

In one specific embodiment of the invention applied to a large bell rod having a diameter of six and one-half inches, the length of access opening 150 is 1 foot 7 inches and its width, eight inches. Further in this embodiment, the overall length of the enclosure is approximately thirteen feet with an internal diameter at the lower sections 40, 40' and 42, 42' of approximately 16 and one-half inches and at the upper reduced diameter sections 44, 44' of approximately nine and one-quarter inches.

What is claimed is:

1. In a blast furnace having a double bell system for charging the furnace through the top thereof, the system including a large bell and a first bell rod for raising and lowering the large bell, and a small bell and a second rod received about the first rod for raising and lowering the small bell, and a first seal between the large and small bell rods at a certain location along the large bell rod; a method of establishing a second seal in situ along the large bell rod at a location spaced from the first seal when the first seal becomes worn, the steps comprising leaving the first seal and the first bell rod in tact, forming an enclosure about the large bell rod at a location above the first seal and with the enclosure having upper and lower open ends, sealing the lower end of the enclosure about the first seal so that any leakage of fluid or material from the interior of the small bell rod along the large bell rod passing through the first seal will be trapped in the enclosure, and sealing the space between the upper end of the enclosure and the large bell rod to seal the interior of the enclosure.

2. The method defined in claim 1 applied to a dual bell system wherein the first bell rod includes two coaxial sections and a joint interconnecting the two coaxial sections above the first seal and wherein the method further includes the step of forming the enclosure to enclose the joint and wherein the second seal is located above the joint.

3. The method defined in claim 1 wherein said enclosure is formed by assembling a plurality of enclosure sections about the first bell rod laterally of the first bell rod.

4. The method defined in claim 1 as applied to a dual bell system including a plurality of elongated hanger rods extending generally parallel to said first and second bell rods and being connected at their lower ends to the second bell rod for use in raising and lowering the second bell rod, and wherein the method further includes the step of securing the enclosure around the first bell rod by connecting the enclosure to the first and second hanger rods.

5. The method defined in claim 1 wherein said second seal is established by inserting a split packing ring around the large bell rod and assembling a split packing gland in the top of the enclosure about the first bell rod and in engagement with the packing ring, the packing ring and packing gland being assembled on the large bell rod laterally of the large bell rod.

6. The method defined in claim 3 applied to a double bell charging system wherein the first seal includes a seal housing and wherein the lower end of the enclosure is secured and sealed to the seal housing of the first seal.

7. In a blast furnace having a double bell system for charging the furnace through the top of the furnace including a large bell rod, a small bell rod received about the large bell rod, and a first seal assembly including at least one seal ring positioned about the large bell rod to seal the interior of the small bell rod; an assembly for establishing a second seal above the first seal around the large bell rod when the first seal ring becomes worn, the assembly including a hollow enclosure positioned about the large bell rod and having a lower end sealed about the first seal assembly, and a second seal between the upper end of the enclosure and the large bell rod for sealing the interior of the enclosure.

8. The combination defined in claim 7 wherein the second seal includes at least one packing ring received about the large bell rod, and a packing gland received about the large bell rod in engagement with the packing ring.

9. The combination defined in claim 7 wherein the large bell rod includes upper and lower portions and a joint interconnecting the upper and lower portions and wherein the enclosure encloses the joint with the second seal being located above the joint.

10. The combination defined in claim 9 wherein said enclosure has an access opening, and a closure member closing the access opening and fastening means releasably fastening the closure to the enclosure about the access opening.

11. The combination defined in claim 10 wherein said access opening of the enclosure is located adjacent said joint.

12. The combination defined in claim 9, said enclosure includes upper and lower coaxial sections surrounding the large bell rod, said lower enclosure section surrounding said joint and said upper enclosure section being located above said joint and having a reduced dimension in the direction transverse to the longitudinal extent of the large bell rod.

13. The combination defined in claim 7 wherein there is further included a plurality of hanger rods extending generally parallel to the large and small bell rods with their lower ends connected to the small bell rod for raising and lowering the same, and wherein there is included means securing an upper end portion of said enclosure to the hanger rods.

14. The combination defined in claim 7 wherein said enclosure includes at least one pair of sections spaced laterally of the large bell rod and secured and sealed together laterally of the bell rod along longitudinally extending edge portions of said sections.

15. The combination defined in claim 14 wherein said sections are generally semicylindrical in shape and together define a generally cylindrical enclosure, and wherein said sections have mating vertical flanges secured together.

16. The combination defined in claim 14 wherein the second seal assembly includes at least one packing ring in sealing engagement about the large bell rod and an associated packing gland extending about the large bell rod and in engagement with said packing ring, and wherein said gland includes two sections spaced laterally of the large bell rod and secured together about the large bell rod.

17. The combination defined in claim 14 wherein said enclosure includes a second pair of sections spaced laterally of the enclosure above said first pair of sections and being secured together along longitudinally extending edge portions thereof, said second pair of sections being secured to said first pair of sections to define with said first pair a continuous space receiving the large bell rod.

18. For use in resealing a large bell rod in a double bell charging system for a blast furnace after the seal between the small and large bell rod has become worn and without requiring shutdown of the blast furnace or removal of the worn seal; an adaptor assembly including two enclosure sections adapted to be placed laterally about the large bell rod above the worn seal and secured and sealed together to form an enclosure about the large bell rod directly above the worn seal, the enclosure sections when assembled about the large bell rod defining an annular space about the bell rod at the upper end of the enclosure sections, and a second seal including a packing ring adapted to be received about the large bell rod in the annular space between the large bell rod in the upper end of the enclosure sections, and a packing gland including two laterally spaced sections adapted to be joined together about and laterally of the large bell rod above the upper end of the enclosure sections with portions of the packing gland in engagement with the packing ring.

19. The adaptor assembly defined in claim 18 wherein upper portions of the enclosure sections include inwardly extending ledge portions for supporting the packing ring when assembled about the large bell rod.

20. The adaptor assembly defined in claim 18 further including a pair of rigid bracket means fixed to and extending laterally outwardly from upper portions of the enclosure sections for securement to actuating rods utilized to raise and lower the small bell rod.

21. The adaptor assembly defined in claim 18 wherein one of said enclosure sections has an access opening therein and wherein there is further included a closure member releasably secured to said one section over the access opening.

22. The adaptor assembly defined in claim 18 wherein said enclosure sections include laterally extending flanges projecting laterally from longitudinal edges of the sections and adapted to be fastened and sealed together to form the enclosure about the large bell rod.

23. The adaptor defined in claim 18 wherein said enclosure sections include upper and lower vertical sections adapted to be fastened and sealed together when assembled about the large bell rod to define a continuous passage receiving the large bell rod.

24. The adaptor assembly defined in claim 23 wherein the lower vertical sections of the enclosure have a transverse dimension greater than that of the upper vertical sections to accommodate a joint in the large bell rod when assembled around the large bell rod.

25. The adaptor assembly defined in claim 23 wherein said upper and lower vertical sections of the enclosure have corresponding horizontal flanges adapted to be mated and fastened and sealed together when the enclosure sections are assembled around the large bell rod.

26. The adaptor assembly defined in claim 25 wherein said enclosure sections include laterally extending flanges projecting laterally from longitudinal edges of the sections and adapted to be fastened and sealed together to form the enclosure about the large bell rod.

27. The adaptor assembly defined in claim 23 wherein said lateral enclosure sections are generally semicylindrical in shape such that when secured about the large bell rod they define a generally hollow cylindrical enclosure.

28. The adaptor assembly defined in claim 23 wherein the upper vertical enclosure sections include inwardly extending ledge portions for supporting the packing ring when assembled about the large bell rod.

29. The adaptor assembly defined in claim 28 wherein one of the lower vertical enclosure sections has an access opening therein and wherein there is further included a closure member releasably secured to said one section about the access opening.

30. The adaptor assembly defined in claim 29 wherein said enclosure sections have vertical flanges for securing sections together on opposite sides of the large bell rod, and further have horizontal flanges for securing said upper and lower sections together.

31. The adaptor assembly defined in claim 30 wherein the enclosure sections are semicylindrical such that when assembled about the large bell rod they define a longitudinal passage axially receiving the large bell rod.

* * * * *